US005687689A

United States Patent [19]

Santos

[11] Patent Number: 5,687,689

[45] Date of Patent: Nov. 18, 1997

[54] AIR COOLED ENGINE SCREEN AND METHOD

[76] Inventor: Eligio Santos, 3890 21st Ave. SW., Naples, Fla. 33964

[21] Appl. No.: 730,082

[22] Filed: Oct. 15, 1996

[51] Int. Cl.[6] ..... F02B 77/00

[52] U.S. Cl. ..... 123/198 E; 123/41.7; 55/490; 55/525

[58] Field of Search ..... 123/198 E, 41.63, 123/41.65, 41.7; 55/525, 490, 491, 495

[56] References Cited

U.S. PATENT DOCUMENTS

| | | | |
|---|---|---|---|
| 3,994,067 | 11/1976 | Hazzard et al. | 123/41.65 |
| 4,156,409 | 5/1979 | Nakano | 123/41.65 |
| 5,285,751 | 2/1994 | Liegeois et al. | 123/41.63 |

OTHER PUBLICATIONS

Filtration and Separation, vol. 10, No. 1, Apr. 3, 1973 p. 47.

*Primary Examiner*—Noah P. Kamen

*Attorney, Agent, or Firm*—Merrill N. Johnson

[57] ABSTRACT

An air-cooled-engine screen (1) is sized and shaped to cover airflow entrances (2) to engines of engine-powered equipment and tools such as chain saws (4). Strands of the screen are designedly strong, fine and spaced apart to allow passage of sufficient air between them to cool the engines while preventing passage of fine particles and/or fibers that are gooey, gummy, resinous or sappy wet and would solidify or gum onto cooling fins and nearby engine parts such as spark-plug connections and cooling-air outlets when being used. Cleaning is facilitated by minimizing screen-surface obstruction. Select attachment means (8, 9, 10, 11 12) are provided for original equipment, for after-market add-on and for various long-term or temporary use conditions.

6 Claims, 2 Drawing Sheets

FIG.1
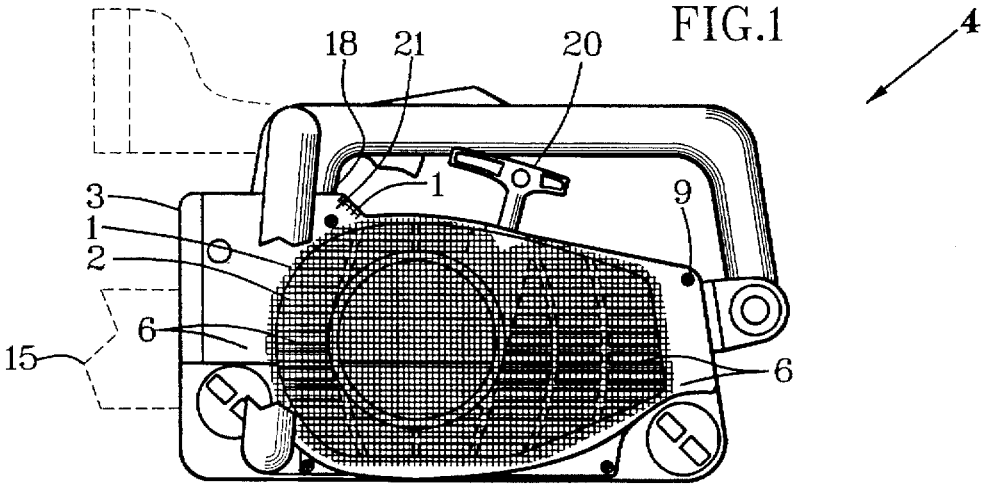
FIG. 2
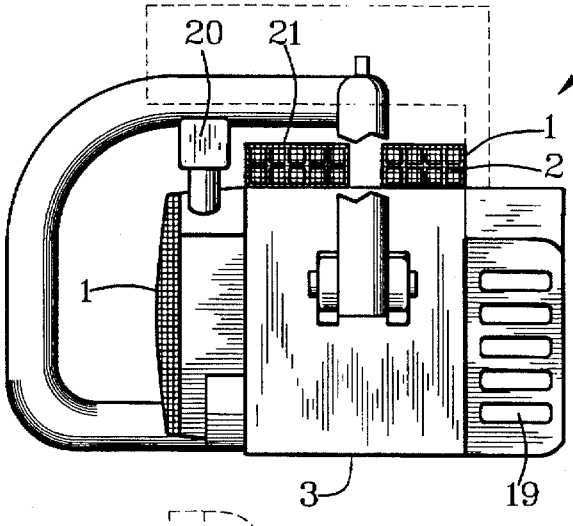
FIG. 3
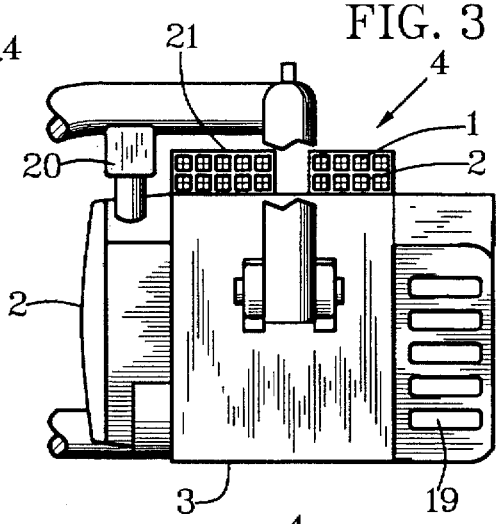
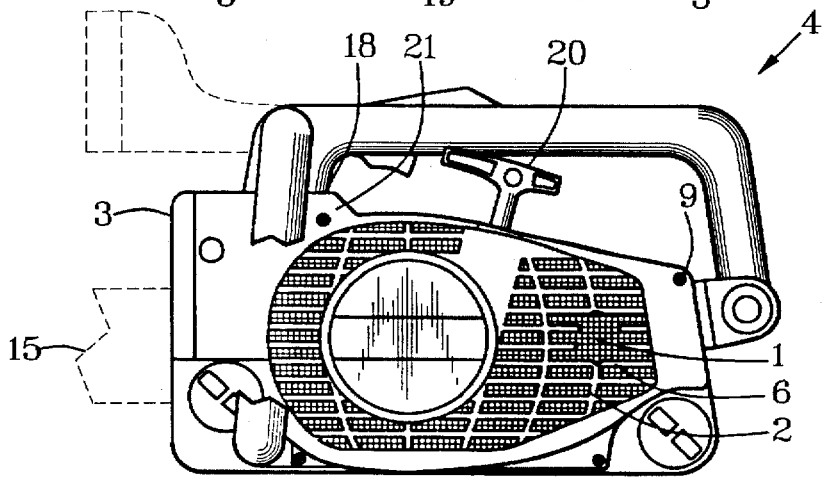
FIG. 4

FIG. 5
FIG. 6
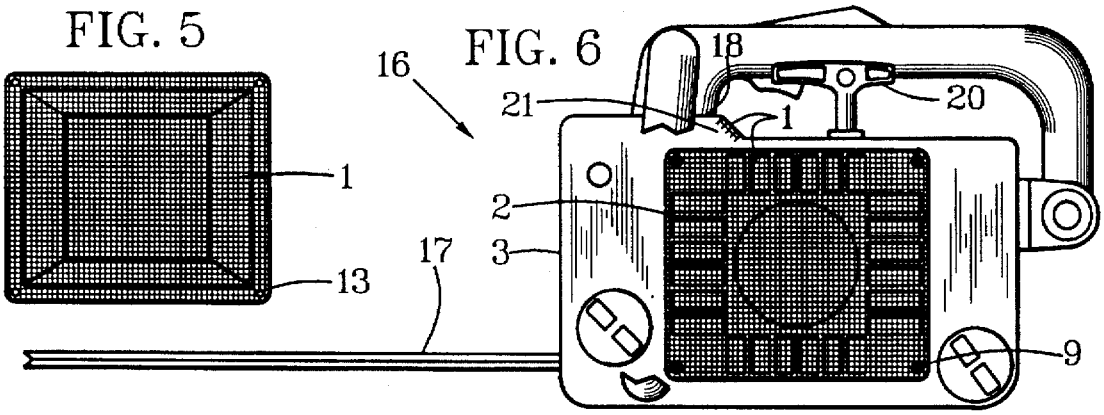
FIG. 7
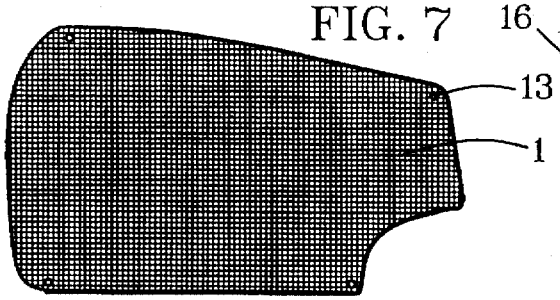
FIG. 9
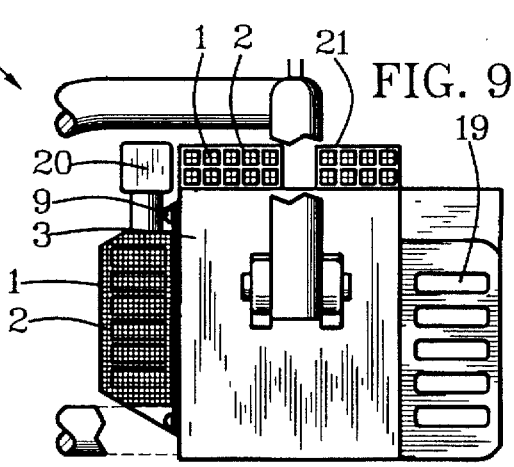
FIG. 8
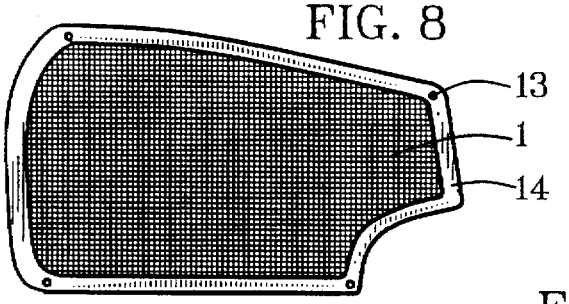
FIG. 12
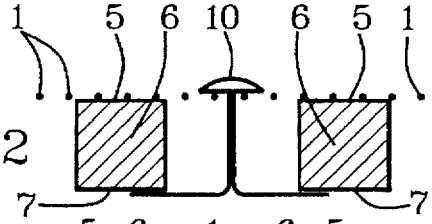
FIG. 10
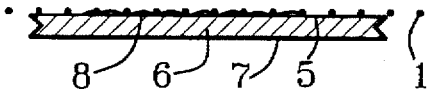
FIG. 13
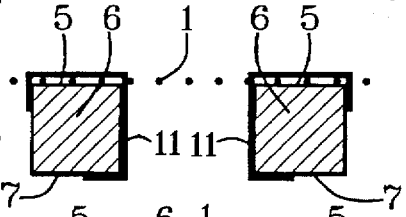
FIG. 11
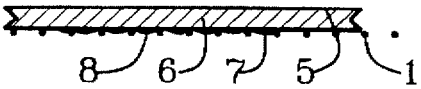
FIG. 14
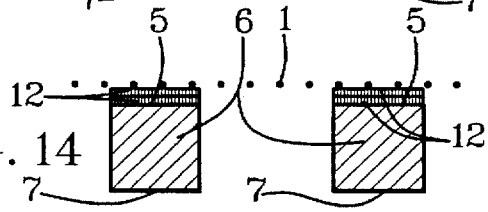

AIR COOLED ENGINE SCREEN AND METHOD

BACKGROUND OF THE INVENTION

1. Field of the Invention.

This invention relates to cooling of engines for powered equipment and tools such as chain saws and in particular to screens to prevent entry of gooey sawdust from palm trees and other sources from obstructing flow of cooling air over cooling fins of air-cooled engines on chain-saw engines and other powered equipment and tools.

2. Relation To Prior Art

Conventionally, chain-saw housings and housings for engines of other powered equipment have variously louvered or slatted covers over air entrances to cooling fins. Their purpose is to prevent entry of obstacles such as leaves and other debris from clogging cooling-air channels. Louvers, slats and fins, however, are inadequate protection against entry of fine particles that are gooey, gummy, resinous or sappy wet from entering and solidifying or gumming on cooling fins. Sawdust from trimming fronds of only a few palm-trees clogs up cooling fins of a chain saw. More time is required to keep a chain saw clean than to cut palm-tree fronds with it. One solution would be to use electrically powered equipment, were it not for distances from electrical outlets and difficulty of access to them by workers who trim palm trees and use other powered equipment. Improvement of entrances to air-cooled-engine equipment is needed to overcome this problem.

SUMMARY OF THE INVENTION

In light of need for improvement of cooling-air entrances to chain-saw engines and to engines of other powered equipment and tools, objects of this invention are to provide an air-cooled-engine screen which:

Prevents entry of fine particles that are gooey, gummy, resinous or sappy wet from entering and solidifying or gumming onto cooling fins;

Does not collect fine and gooey substances;

Does not obstruct flow of cooling air;

Can be wiped clean easily and conveniently whenever necessary; Is resistant to breakage and puncture;

Can be attached easily as after-market add-on to existing engine-powered chain saws and other air-cooled-engine equipment; Can be made optionally to be removable and replaceable quickly and conveniently; and Can be produced inexpensively with original equipment.

This invention accomplishes these and other objectives with an air-cooled-engine screen that is sized and shaped to cover airflow entrances to engines of engine-powered equipment and tools such as chain saws. Strands of the screen are designedly strong, fine and spaced apart to allow passage of sufficient air between them to cool the engines while preventing passage of fine particles and/or fibers that are gooey, gummy, resinous or sappy wet and would solidify or gum onto cooling fins and nearby engine parts such as spark-plug connections and cooling-air outlets when being used. Cleaning is facilitated by minimizing screen-surface obstruction. Select attachment means are provided for original equipment, for after-market add-on and for various long-term or temporary use conditions.

BRIEF DESCRIPTION OF DRAWINGS

This invention is described by appended claims in relation to description of a preferred embodiment with reference to the following drawings which are described briefly as follows:

FIG. 1 is a partially cutaway side elevation view of a screen adhered to an outside surface of airflow entrances to an air-cooled engine for a chain saw;

FIG. 2 is a rear view of the FIG. 1 illustration; FIG. 3 is a partially cutaway rear elevation view of a screen adhered to an inside surface of airflow entrances to an air-cooled engine for a chain saw;

FIG. 4 is a side elevation view of the FIG. 3 illustration;

FIG. 5 is a front view of a screen that is formed to fit onto generally rectangular airflow entrances to an air-cooled engine;

FIG. 6 is a partially cutaway side elevation view of a screen on a hedge trimmer which illustrates a similar working relationship of the screen to generally rectangular airflow entrances to an air-cooled engine for some types of chain saws;

FIG. 7 is a contoured screen having fastener orifices for a generally elliptical pattern of airflow entrances to an air-cooled engine for a chain saw as illustrated in FIGS. 1–4;

FIG. 8 is a contoured screen having fastener orifices in a screen border for a generally elliptical pattern of airflow entrances to an air-cooled engine for a chain saw as illustrated in FIGS. 1–4;

FIG. 9 is a rear view of the FIG. 6 illustration;

FIG. 10 is an enlarged fragmentary view of a section of screen on an outside periphery of an engine enclosure;

FIG. 11 is an enlarged fragmentary view of a section of screen on an inside periphery of an engine enclosure;

FIG. 12 is an enlarged fragmentary view of a section of screen attached to an outside periphery of an engine enclosure with a single hook having hook members in contact with engine enclosure members at opposite sides of an airflow entrance;

FIG. 13 is an enlarged fragmentary view of a section of screen attached to an outside periphery of an engine enclosure with two separate hooks having hook members in contact with engine enclosure members at opposite sides of an airflow entrance; and FIG. 14 is an enlarged fragmentary view of a section of screen attached to an outside periphery of an engine enclosure with a pliable hook system such as VELCRO® having a first plurality of pliable hook members attached to the screen and a second plurality of pliable hook members attached to the engine enclosure proximate airflow entrances.

DESCRIPTION OF PREFERRED EMBODIMENT

Reference is made first to FIGS. 1–4 in the drawings. At least one screen 1 is sized and shaped to cover airflow entrances 2 to an air-cooled engine in an engine enclosure 3 for an engine-powered item such as a chain saw 4. Strands of the screen 1 have tensile strength, toughness, spaced-apart distances and strand-crossing distances to allow required airflow through the screen 1 while preventing passage of engine-gumming material through the screen 1. An example of screening material found to be suitable for use in cutting palm-tree fronds has plastic coated fiberglass strands and approximately sixteen openings per inch.

Referring to FIGS. 1–4, 6, and 10–14, the screen 1 can be on an outside surface 5 of entrance material 6 as shown in FIGS. 1, 2, 6, 10 and 12–14 or on an inside surface 7 of entrance material 6 as shown in FIGS. 3, 4, 9 and 11.

Referring to FIGS. 1–14, means for attachment of the screen to the enclosure 3 is preferably by bonding as depicted in FIGS. 1–4 and 10–11. Bonding can be accomplished with a high-bond adhesive 8 such as Crazy Glue® or various other types of known bonding agents and processes as illustrated in FIGS. 1–4 and 10–11. Alternative to high-bond adhesive 8 as means of attachment can be threaded fasteners 9 shown in FIGS. 6 and 9, two-pronged hooks 10 shown in FIG. 12, single-pronged hooks 11 shown in FIG. 13 and VELCRO® 12 shown in FIG. 14. For use of VELCRO® or other resilient-hook attachments, a first layer can be affixed to the screen 1 and a second layer can be attached to the entrance material 6 and/or the engine enclosure 3 surrounding the airflow entrances 2. Screen-attachment apertures 13 in the screen 1 as shown in FIGS. 5–7 or in a screen border 14 as shown in FIG. 8 can be provided for insertion and containment of the threaded fasteners 9.

The chain saw 4 with a chain blade 15 depicted in FIGS. 1–4 and a hedge trimmer 16 with a vibrator blade 17 depicted in FIGS. 6 and 9 are two of the more common powered items for which this invention is most advantageous. Other powered items needing this invention are foreseeable. Typically, they are hand-held items that require light weight and low cost of an air-cooled, two-stroke engine instead of higher efficiency and higher cost of other known engines.

Some chain saws 4 and some hedge trimmers 16 have airflow entrances 2 in a generally elliptical patters as depicted in FIGS. 1 and 4. Others are more rectangular as depicted in FIGS. 6 and 9. The screens 1 for either can be shaped and formed accordingly as indicated by the rectangular form of screen 1 in FIG. 5 and the generally elliptical form of screen 1 in FIGS. 7–8.

Some chain saws 4 and fewer hedge trimmers 16 have airflow entrances 2 on top near a handle connection 18 or a surge pump. Air vents 19 on backs of engine enclosures 3 usually are not entrances but are exits which do not require covering. This invention is intended to cover all airflow entrances 2, no matter where they are positioned and regardless of how many there are. Covering groupings of airflow entrances 2 is preferable to covering single airflow entrances 2.

Installing the screen 1 over the airflow entrances 2 on the engine enclosure 3 can be accomplished during manufacture or as after-market add-ons afterwards. The same installation factors with appropriate procedural adaptations apply for both. Inside-surface positioning may be preferable during manufacture for some manufacturers in order to achieve a desired appearance and to provide greater protection of the screen 1 during use conditions. For inside-surface installation, it is important that the entrance material 6 be as thin as possible between the outside surface 5 and the inside surface 7 as described in relation to FIG. 11 in order to minimize debris crevices and to facilitate cleaning of the screen 1. Also for inside-surface installation, arcuate outside surfaces of entrance material 6 is preferable for eliminating crevices. After-market add on with high-bond adhesive 8 is preferable for ease of cleaning and eliminating debris crevices. A cutaway section in the entrance material 6 in FIG. 4 depicts inside-surface 7 positioning on preferably thin entrance material 6.

As illustrated in FIGS. 1–4, 6 and 9, a patterned positioning of airflow entrances 2 on most engine enclosures 3 surrounds a plate for a starter wheel that is accessed by a starter line on a pull-start handle 20 for most conventional powered items. A new and useful air-cooled-engine screen having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An air-cooled-engine screen for an air-cooled engine within an engine enclosure comprising:

at least one screen that is sized and shaped to cover airflow entrances to the air-cooled engine in the engine enclosure for an engine-powered item;

strands of the screen which have tensile strength, toughness, spaced-apart distances and strand-crossing distances to allow the required airflow through the screen while preventing passage of engine-gumming material through the screen; and a means for attaching the screen to the engine enclosure in covering position on the airflow entrances wherein the means for attaching the screen to the engine enclosure is high-strength adhesive that is applied to intermediate select attachment-side surfaces of the screen and select outside surfaces of the engine enclosure; and an outside surface of the screen is free of obstruction for ease of being wiped clean and brushed clean.

2. An air-cooled-engine screen for an air-cooled engine within an engine enclosure comprising:

at least one screen that is sized and shaped to cover airflow entrances to the air-cooled engine in the engine enclosure for an engine-powered chain saw;

strands of the screen which have tensile strength, toughness, spaced-apart distances and strand-crossing distances to allow the required airflow through the screen while preventing passage of engine-gumming material through the screen; and a means for attaching the screen to the engine enclosure in covering position on the airflow entrances wherein the means for attaching the screen to the engine enclosure is high-strength adhesive that is applied to intermediate select attachment-side surfaces of the screen and select outside surfaces of the engine enclosure; and an outside surface of the screen is free of obstruction for ease of being wiped clean and brushed clean.

3. An air-cooled-engine screen for an air-cooled engine within an engine enclosure comprising;

at least one screen that is sized and shaped to cover airflow entrances to the air-cooled engine in the engine enclosure for an engine-powered item;

strands of the screen which have tensile strength, toughness, spaced-apart distances and strand-crossing distances to allow the required airflow through the screen while preventing passage of engine-gumming material through the screen; and a means for attaching the screen to the engine enclosure in covering position on the airflow entrances wherein the means for attaching the screen to the engine enclosure is a plurality of hooks having hook members hooked onto inside surfaces of the engine enclosure and onto the screen proximate peripheral edges of the airflow entrances.

4. An air-cooled-engine screen for an air-cooled engine within an engine enclosure comprising:

at least one screen that is sized and shaped to cover airflow entrances to the air-cooled engine in the engine enclosure for an engine-powered chain saw;

strands of the screen which have tensile strength, toughness, spaced-apart distances and strand-crossing distances to allow the required airflow through the screen while preventing passage of engine-gumming material through the screen; and a means for attaching the screen to the engine enclosure in covering position on the airflow entrances wherein the means for attaching the screen to the engine enclosure is a plurality of hooks having hook members hooked onto inside surfaces of the engine enclosure and onto the screen proximate peripheral edges of the airflow entrances.

5. An air-cooled-engine screen for an air-cooled engine within an engine enclosure comprising:

at least one screen that is sized and shaped to cover airflow entrances to the air-cooled engine in the engine enclosure for an engine-powered item;

strands of the screen which have tensile strength, toughness, spaced-apart distances and strand-crossing distances to allow the required airflow through the screen while preventing passage of engine-gumming material through the screen; and a means for attaching the screen to the engine enclosure in covering position on the airflow entrances wherein the screen has a peripheral border with fastener apertures that are sized, shaped and positioned to receive fastener members that are attachable to the engine enclosure.

6. An air-cooled-engine screen for an air-cooled engine within an engine enclosure comprising:

at least one screen that is sized and shaped to cover airflow entrances to the air-cooled engine in the engine enclosure for an engine-powered item;

strands of the screen which have tensile strength, toughness, spaced-apart distances and stand-crossing distances to allow the required airflow through the screen while preventing passage of engine-gumming material through the screen; and a means for attaching the screen to the engine enclosure in covering position on the airflow entrances wherein the means for attaching the screen to the engine enclosure is a pliable hook system like VELCRO® having a first plurality of pliable hook members attached to the screen and a second plurality of pliable hook members attached to the engine enclosure proximate airflow entrances.

* * * * *